US005976059A

United States Patent [19]

Brown

[11] Patent Number: 5,976,059

[45] Date of Patent: Nov. 2, 1999

[54] MULTIDIRECTIONAL ROTARY EXERCISER

[76] Inventor: Matthew G. Brown, 204 W. Water St., Centerville, Iowa 52544

[21] Appl. No.: 09/016,249

[22] Filed: Jan. 30, 1998

[51] Int. Cl.[6] ..... A63B 21/02

[52] U.S. Cl. ..... 482/44; 482/121; 482/122; 482/126; 482/127; 482/46; 482/49; 482/139; 482/148

[58] Field of Search ..... 482/44–46, 121, 482/122, 126, 127, 49, 139, 148, 908; D21/673, 677, 684; 73/379.02, 379.03, 379.08

[56] References Cited

U.S. PATENT DOCUMENTS

| | | | |
|---|---|---|---|
| 2,973,962 | 3/1961 | Griffin | 482/46 |
| 3,084,547 | 4/1963 | Nielsen | 482/49 |
| 3,717,338 | 2/1973 | Hughes | 482/46 |
| 5,046,727 | 9/1991 | Wilkinson et al. | 482/45 |
| 5,160,303 | 11/1992 | Smith | 482/123 |
| 5,720,701 | 2/1998 | Truini | 482/126 |
| 5,743,830 | 4/1998 | Ho | 482/44 |

*Primary Examiner*—Richard J. Apley
*Assistant Examiner*—Lori L. Baker Smith
*Attorney, Agent, or Firm*—Zarley, McKee, Thomte Voorhees & Sease; Dennis L. Thomte

[57] ABSTRACT

An exercise device includes a pair of handles with elongated shafts operatively interconnected for rotation along coaxial longitudinal axes. Each shaft has a hand grip at the distal ends to permit a consumer to grip the handle and rotate the handles in opposite directions along their longitudinal axes. Diametric posts project orthogonal from the proximal ends of the shafts and pairs of adjacent posts have an elastic band looped around the posts to resist rotational movement of the shafts.

8 Claims, 3 Drawing Sheets

MULTIDIRECTIONAL ROTARY EXERCISER

TECHNICAL FIELD

The present invention relates generally to apparatus for exercising the hand, wrist and forearm, and more particularly to an improved multidirectional rotary exerciser.

BACKGROUND OF THE INVENTION

Many types of equipment currently exists for exercising various parts of the body. Because of the increasing interest in fitness, there has been a move toward specializing exercise equipment to development only one portion or region of the body. The present invention is directed to an exerciser for the hands, wrists, and forearms of a human.

SUMMARY OF THE INVENTION

It is therefore a general object of the present invention to provide an improved exercise apparatus for exercising the hands, wrist and forearms of a human.

Another object is to provide an exerciser which is multidirectional and simple to operate.

A further object of the present invention is to provide an improved exerciser which is economical to manufacture, and refined in appearance.

These and other objects of the present invention will be apparent to those skilled in the art.

The exercise device of the present invention includes a pair of handles with elongated shafts operatively interconnected for rotation along coaxial longitudinal axes. Each shaft has a hand grip at the distal ends to permit a consumer to grip the handle and rotate the handles in opposite directions along their longitudinal axes. Diametric posts project orthogonal from the proximal ends of the shafts and pairs of adjacent posts have an elastic band looped around the posts to resist rotational movement of the shafts.

DESCRIPTION OF THE PREFERRED EMBODIMENT

Figure 1:
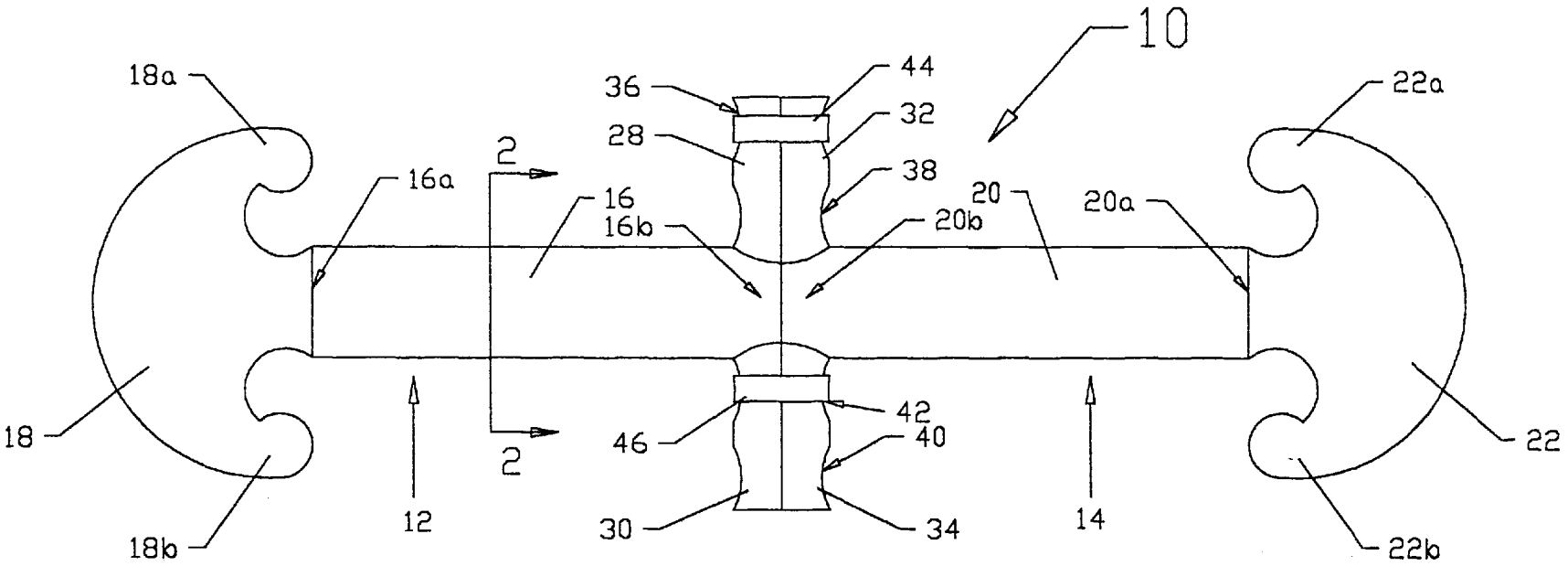
FIG. 1 is a front elevational view of the exerciser of the present invention.

Referring now to the drawings, in which similar or corresponding parts are identified with the same reference numeral, and more particularly to FIG. 1, the multidirectional rotary exerciser of the present invention is designated generally at 10 and includes a pair of handles 12 and 14 which are operably interconnected for selective rotation about a coaxial rotational axis.

Handle 12 includes an elongated shaft 16 having a distal end 16*a* and a proximal end 16*b*. A hand grip 18 is fastened on the distal end 16*a* of shaft 16, to permit the grip to be grasped in the human hand and rotated on the longitudinal axis of shaft 16.

Handle 14 is similar to handle 12, and includes an elongated shaft 20 with distal and proximal ends 20*a* and 20*b*, and a hand grip 22 on the distal end of shaft 20. Grips 18 and 22 preferably include arms 18*a* and 18*b*, and 22*a* and 22*b*, which project orthogonally outward from the longitudinal axis of shafts 16 and 20 respectively. Arms 18*a*, 18*b*, 22*a* and 22*b* provide surface area for a secure grip on hand grips 18 and 22 respectively.

Figure 3:
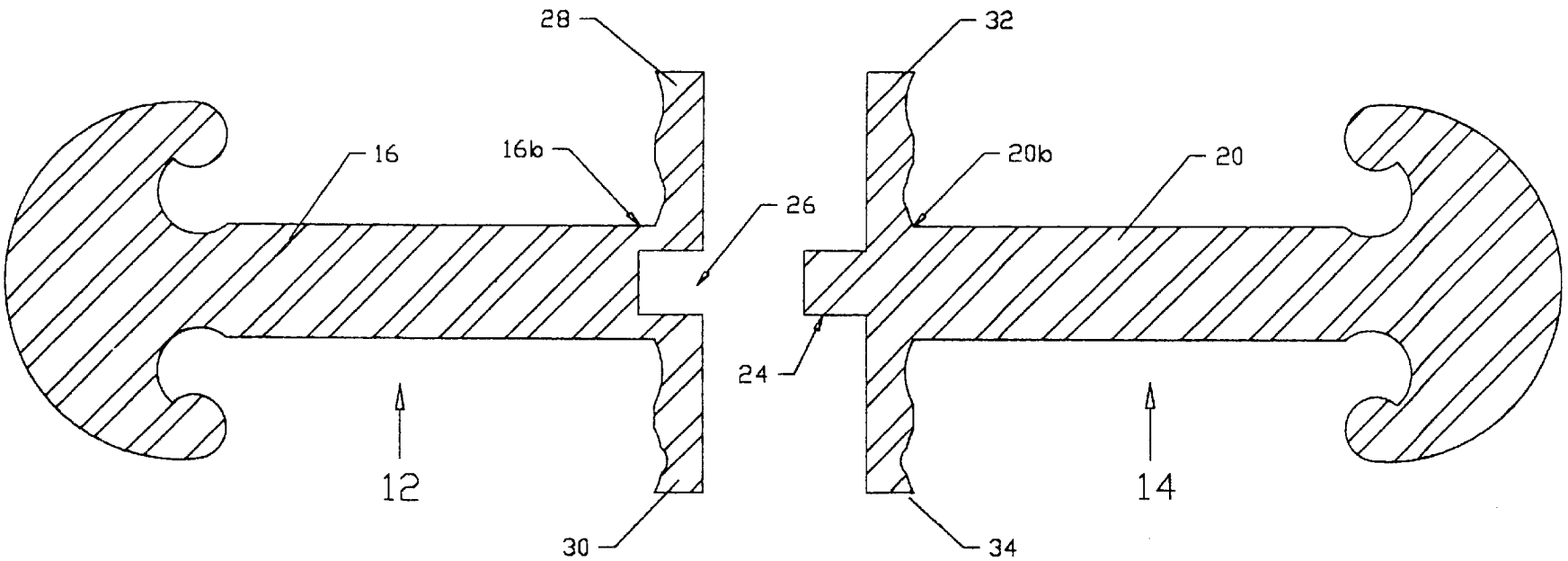
FIG. 3 is an exploded vertical sectional view through the exerciser.

Referring now to FIG. 3, handle 14 includes a cylindrical pivot pin 24 which has its longitudinal axis coaxial with the longitudinal axis of shaft 20, and which projects outwardly from the proximal end 20*b* of shaft 20. A socket 26 formed in the proximal end 16*b* of shaft 16 is sized and shaped to rotatably receive pin 24 therein such that shafts 16 and 20 are coaxially aligned, and rotatable about a coaxial longitudinal axis. Thus, when pin 24 is journaled within socket 26, shafts 16 and 20 may be freely rotated about their common coaxial axes.

Handle 12 includes a pair of semi-cylindrical posts 28 and 30 which are mounted on the proximal end 16*b* of shaft 16, and which project orthogonal to the longitudinal axis of shaft 16 and diametric to one another. A similar pair of diametric semi-cylindrical posts 32 and 34 are also mounted on the proximal end 20*b* of shaft 20. Posts 28 and 32 are arranged so as to form a full cylindrical post when pin 24 is journaled within socket 26 and rotated to align posts 28 and 32. Similarly, posts 30 and 34 will form a cylindrical post when pin 24 is journaled within socket 26.

Referring once again to FIG. 1, posts 28 and 32 include an annular groove 36 formed in their circumferential surface, and oriented perpendicular to the longitudinal axis of posts 28 and 32. Groove 36 is located adjacent the outward ends of posts 28 and 32. A second annular groove 38 is formed around posts 28 and 32 inwardly of groove 36 and parallel thereto. A similar pair of outward and inward grooves 40 and 42 are formed in the circumferential surfaces of posts 30 and 34.

A band 44 of stretchable elastic material is positioned within outward groove 36 on posts 28 and 32. A second band 46 of stretchable elastic material is positioned in inward groove 42 on posts 30 and 34. Bands 44 and 46 provide two separate functions. First, they will serve to bias handles 12 and 14 towards one another, with pin 24 rotatably engaged within socket 26 (shown in FIG. 3). Second, each band will provide predetermined resistance to rotatable separation of posts 28 from 32, and from posts 30 from 34.

Figure 2:
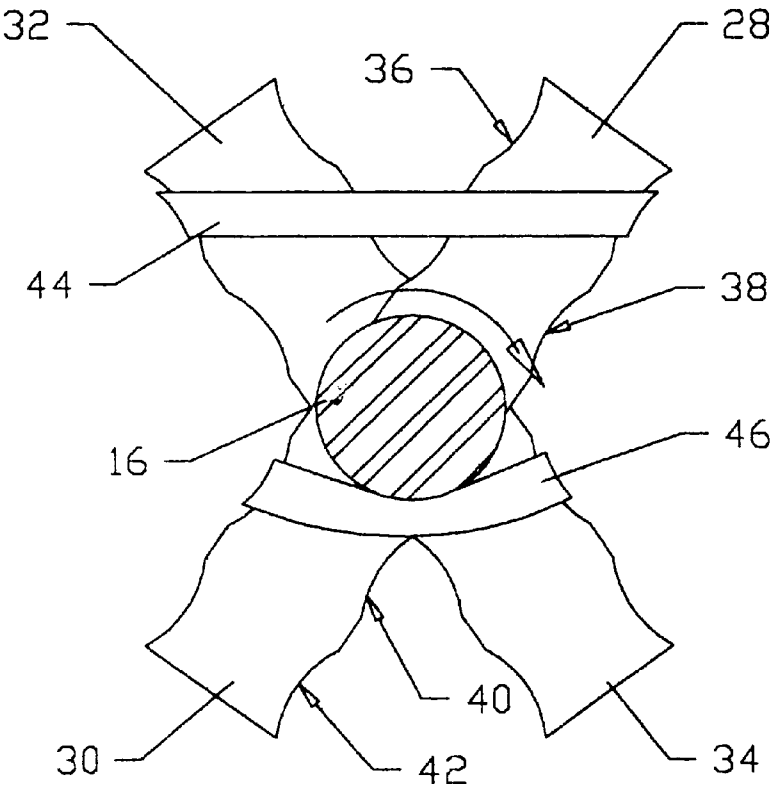
FIG. 2 is a sectional view taken at lines 2—2 in FIG. 1.

As shown in FIG. 2, exerciser 10 is shown moved to a biased position with post 28 separated from post 32, thereby stretching band 44, and post 30 separated from post 34 to thereby stretch band 46. It can be seen that the relative distance of separation between the corresponding posts is lesser at inward grooves 38 and 40, as compared to outward grooves 36 and 42. Thus, the amount of resistance may be easily adjusted by moving one or both bands 44 and 46 to the inward grooves or the outward grooves. Also, additional bands may be added in one or both grooves of posts 28, 30, 32, and 34 to increase resistance.

In operation, the consumer will position band 44 in either groove 36 or 38, and will position band 46 in either groove 40 and 42, depending upon the amount of resistance desired. The consumer will then grasp hand grips 18 and 22 and twist handles 12 and 14 in opposite directions on their longitudinal axes. This causes posts 28 and 32 to separate, and posts 30 and 34 to separate, by stretching bands 44 and 46. The resistance of the elastic material of bands 44 and 46 thereby exercises the hands, wrists and forearms of the consumer.

Whereas the multidirectional rotary exerciser of the present invention has been shown and described in connection with the preferred embodiment thereof, many modifications, substitutions and additions may be made which are within the intended broad scope of the appended claims.

I claim:

1. An exercise device, comprising:

first and second handles operatively interconnected for rotation along coaxial longitudinal axes;

each handle having an elongated shaft with proximal and distal ends and a longitudinal axis coaxial with the handle longitudinal axes;

said shafts operatively connected together at their proximal ends for independent rotation on their longitudinal axes; and resistance means connected between the shafts for resisting rotational movement of one shaft relative to the other shaft.

2. The exercise device of claim 1, further comprising:

said first and third posts having a first annular groove formed therein within a plane parallel to the longitudinal axes of the shafts;

said first band extending around said first and third posts and engaged within the first annular groove;

said second and fourth posts having a first annular groove formed therein within a plane parallel to the longitudinal axes of the shafts; and said second band extending around said second and fourth posts and engaged within the first annular grooves.

3. The exercise device of claim 2, further comprising:

said first and third posts having a second annular groove parallel to the first groove and spaced inwardly thereon towards the shafts;

said second and fourth posts having a second annular groove parallel to the first groove and spaced inwardly thereon towards the shafts;

said first band selectively engaging one of said first and second grooves on the first and third posts; and said second band selectively engaging one of said first and second grooves on said second and fourth posts.

4. The exercise device of claim 3, wherein said posts are generally semicylindrical in shape, and wherein the first and third posts are oriented to form a cylinder when in proximal unbiased orientation, and wherein the second and fourth posts are oriented to form a cylinder when in proximal unbiased orientation.

5. An exercise device, comprising:

first and second handles operatively interconnected for rotation along coaxial longitudinal axes;

each handle having an elongated shaft with proximal and distal ends and a longitudinal axis coaxial with the handle longitudinal axes;

said shafts operatively connected together at their proximal ends for independent rotation on their longitudinal axes;

resistance means connected between the shafts for resisting rotational movement of one shaft relative to the other shaft;

first and second posts mounted on a proximal end of the first handle shaft and projecting diametric and orthogonal to the shaft;

third and fourth posts mounted on the proximal end of the second handle shaft and projecting diametric and orthogonal to the shaft;

said resistance means including first biasing means interconnecting the first and third posts, for resisting separation of the first and third posts, and second biasing means interconnecting the second and fourth posts, for resisting separation of the second and fourth posts; and said first biasing means including a first elastic band extending in a loop around both the first and third posts, and said second biasing means including a second elastic band extending in a loop around the second and fourth posts.

6. The exercise device of claim 5, further comprising:

said first and third posts having a first annular groove formed therein within a plane parallel to the longitudinal axes of the shafts;

said first band extending around said first and third posts and engaged within the first annular groove;

said second and fourth posts having a first annular groove formed therein within a plane parallel to the longitudinal axes of the shafts; and said second band extending around said second and fourth posts and engaged within the first annular grooves.

7. The exercise device of claim 6, further comprising:

said first and third posts having a second annular groove parallel to the first groove and spaced inwardly thereon towards the shafts;

said second and fourth posts having a second annular groove parallel to the first groove and spaced inwardly thereon towards the shafts;

said first band selectively engaging one of said first and second grooves on the first and third posts; and said second band selectively engaging one of said first and second grooves on said second and fourth posts.

8. The exercise device of claim 5, wherein said posts are generally semicylindrical in shape, and wherein the first and third posts are oriented to form a cylinder when in proximal unbiased orientation, and wherein the second and fourth posts are oriented to form a cylinder when in proximal unbiased orientation.

* * * * *